US005413252A

United States Patent [19]

Magnus

[11] Patent Number: 5,413,252

[45] Date of Patent: May 9, 1995

[54] FRUIT JUICE DISPENSER

[75] Inventor: Eberhard Magnus, Remscheid, Germany

[73] Assignee: Mastermark Corporation, Louisville, Ky.

[21] Appl. No.: 140,159

[22] PCT Filed: Apr. 4, 1992

[86] PCT No.: PCT/EP92/00761

§ 371 Date: Oct. 27, 1993

§ 102(e) Date: Oct. 27, 1993

[87] PCT Pub. No.: WO92/19529

PCT Pub. Date: Nov. 12, 1992

[30] Foreign Application Priority Data

May 2, 1991 [DE] Germany ..... 9105439 U

[51] Int. Cl.[6] ..... B65D 35/00

[52] U.S. Cl. ..... 222/129.1; 222/214; 222/325; 417/476

[58] Field of Search ..... 222/129.1, 214, 325, 222/129.2, 333; 417/476, 477

[56] References Cited

U.S. PATENT DOCUMENTS 3,750,908 8/1973 Bauerlein et al. .

FOREIGN PATENT DOCUMENTS 0214443 3/1987 European Pat. Off. .
0266202 5/1988 European Pat. Off. .
3202251 8/1983 Germany .

*Primary Examiner*—Gregory L. Huson
*Attorney, Agent, or Firm*—Martin A. Farber

[57] ABSTRACT

A fruit juice dispenser or the like has a receiving device (1) for a concentrate container (3), and is equipped with a spigot hose (5), having a hose pump (7) which is driven by an electric motor. A squeezing device extends into a hose-receiving chamber (15), and is displaceable in direction of conveyance. An electromagnetically controlled water-feed device (8) is arranged between the hose pump (7) and the spigot opening. To obtain the greatest possible reliability in operation with a compact arrangement, there is provided a linear course of the spigot hose (5) from the concentrate container (3) to the spigot valve (6). The pump includes a plate-block squeezing contour (W) against which contour the spigot hose (5) is held by means of a spring-actuated rear wall (13) of a flap (16) which can be opened in forward direction for the insertion of the spigot hose (5).

7 Claims, 5 Drawing Sheets

FRUIT JUICE DISPENSER

FIELD AND BACKGROUND OF THE INVENTION

The present invention relates to a fruit juice dispenser or the like having a receiving device for a concentrate container provided with a spigot hose, the dispensers having a hose pump driven by an electric motor with a squeezing means which extends into a hose receiving chamber and can be displaced in the direction of conveyance, and having an electromagnetically controlled water feed device arranged between the hose pump and spigot opening.

In one fruit juice dispenser which is today on the market, a collapsible container in which fruit juice concentrate is contained is received in a receiving device developed as cooling compartment which is cooled by a cooling unit. The concentrate can be removed from the concentrate container by a spigot hose which is arranged on the bottom of the container and the end of which is connected to a spigot valve. In such a fruit juice dispenser the spigot valve is adapted to be connected to a water feed device which dilutes the concentrate with water before it emerges from the spigot opening.

The fruit juice concentrate is pumped or fed in dosed amount from the container through the spigot hose by means of a pump. In the known fruit juice dispenser, a hose pump is used which prevents direct contact between the fruit juice concentrate and the pump. The hose pump consists of a rotating pump disk on the edge of which squeezing means are arranged which can move away inward against spring force, in this case in the form of squeeze rollers, said means pressing the hose, placed against the rear wall around the disk, in such a manner that constrictions are produced in the hose, these constrictions being moved along by the rotation in the direction of conveyance. By this peristalsis, which is produced by a stripping-out movement, a volume transport up to the spigot opening is assured.

Such a pump has the disadvantage, on the one hand, of excessive wear and, on the other hand, of taking up a relatively large amount of space. The wear is due essentially to the strong stripping-out action of the rollers. This furthermore results in a creeping and thus to a tensioning of the spigot hose which lead to its flattening. The places of connection must therefore be made very stable in order to counteract the possible risk of tearing. Furthermore, as a result of the arcuate deflection of the spigot hose around the pump disk, which is approximately of palm size, an unnecessary excess length of the pump hose results. The said relatively large amount of space required is due to the swinging away movement of the bow-shaped rear wall near the housing. Handling is also inconvenient, since work must be done on the front surface of the apparatus. There are scarcely sufficient gripping possibilities.

SUMMARY OF THE INVENTION

The object of the present invention, therefore, is so to develop a fruit juice dispenser of this type that, despite its compactness, the greatest possible dependability in operation is achieved.

By virtue of the invention, there is provided a fruit juice dispenser of this type in which the hose pump is so compact that several hose pumps can also be arranged closely alongside of each other. Furthermore, due to the fact that rotating squeezing elements are dispensed with, the dependability of operation is increased. This is achieved by a linear path of the spigot hose from the concentrate container to the place of the spigot and by a plate-block squeezing contour which operates transverse thereto as hose pump, the spigot hose being held against said contour by means of the spring-loaded rear wall of a flap which can be opened towards the front in order to insert the spigot hose. The spigot hose now extends directly, in maximum short length, from the fruit-juice supply to the spigot opening. This saves material and permits the peristaltic action to take place over a shorter path and without any stretching tension on the body of the hose.

Therefore, the above-mentioned stripping-out action does not take place here, since the plate-block squeezing contour which operates transverse to the linear course of the hose produces only correspondingly transversely directed indentations in the hose body. This takes place with much less wear and thus more gently than would be possible by squeeze rollers of the aforementioned pump disk. Furthermore, better conditions are also present for the attachment and removal of the hose, since this is done via a flap which can be opened towards the front. Therefore, handling is effected directed frontally and not in the plane of the front wall of the fruit juice dispenser.

In order to produce an effective constricting and to compensate for possible hose tolerances, the rear wall of the hose receiving chamber is under spring action, as mentioned. It presses the hose substantially "floatingly" against the squeezing contour. An exact positioning as well as an attachment of the hose which assures the linear course is obtained by openings on the hose-chamber side for the passage or insertion of the spigot hose. Such openings may be arranged on the flap. In a preferred further development of the invention, the pump housing wall has openings on the hose receiving chamber side, said openings forming the bearing for the plate-block eccentric shaft for the removing of the plate block, including the eccentric shaft, from the pump housing. This is useful, in particular, for the cleaning of the hose pump.

By this further development, a user-friendly disassembling of the hose pump is also made possible. The eccentric shaft is preferably clipped to the hose-receiving-chamber-side openings forming the bearings. In order furthermore to assure a sufficient width of action of the plate block, the further development is such that the width of the end surface of the plates corresponds to a multiple of the diameter of the hose hole. This end surface is preferably somewhat larger than the width of the hose when the body of the hose is pressed flat. A stress-free dosing, which nevertheless is precisely defined on both ends by constrictions, is present when the squeezing contour corresponds to half the length of the wave. What is meant is the extending into and out of a line formed by the linearly extending hose. A further advantageous measure is furthermore achieved by a flow control device for the feeding of the water such that a given open period of the solenoid valve of the water-feed device corresponds to a given amount of water admitted.

In this connection, it is advantageous for the flow-control device to be developed as a signal impeller which is turned by the flowing water and the signals from which serve to control the drive voltage of the hose-pump electric motor. Control which is independent of the water pressure present can be obtained with such a signal impeller device. As signal, there can be used, for instance a small magnet seated on the impeller vane and the recurring approach of which, i.e. the resultant speed of rotation of the impeller, is converted by a pulse receiver.

BRIEF DESCRIPTION OF THE DRAWINGS

With the above and other advantages in view, the present invention will become more clearly understood in connection with the detailed description of a preferred embodiment, when considered with the accompanying drawings of which.

Embodiments of the invention will be explained in further detail with reference to the drawings, in which.

DETAILED DESCRIPTION OF THE PREFERRED EMBODIMENT

Figure 1:
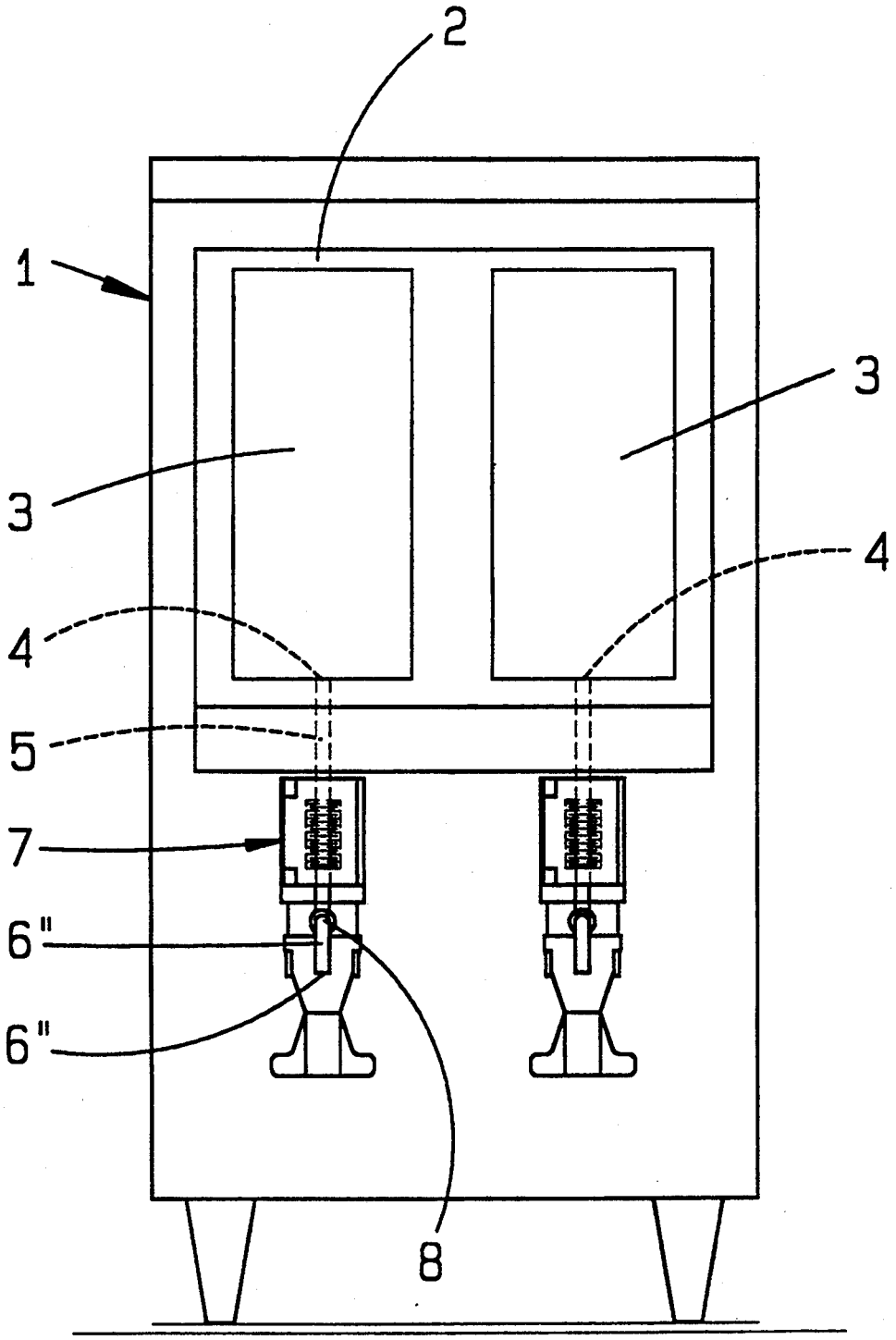
FIG. 1 is a view of a fruit juice dispenser having two separate concentrate containers and hose pumps, shown substantially diagrammatically.

FIG. 1 shows a fruit juice dispenser 1 having a receiving chamber 2 for two concentrate containers 3 which consist of a multi-layer plastic-foil material and which are closed and collapsible, except for an outlet opening 4, in order to prevent microbial contamination. The outlet opening adjoins a spigot hose 5 which extends into a spigot valve 6. The spigot hose extends linearly vertically between concentrate container 3, or its outlet opening 4, and the spigot point formed by the spigot valve 6. Between the spigot valve 6 and the opening 4, the spigot hose lies in a hose pump 7 which doses and conveys the discharge of the concentrate. The spigot valve 6 can be opened or closed by turning the spigot spout 6''. The closed position is intended basically for the replacement or transportation of the container 3.

Behind the hose pump 7 and adjacent the spigot valve 6 the fruit juice dispenser 1 has a water-feed device 8 by which water is added to the concentrate conducted through the spigot hose 5 so that the diluted fruit juice, which is now drinkable, can be removed from the spigot opening 6' of the spigot valve 6.

Figures 2, 4:
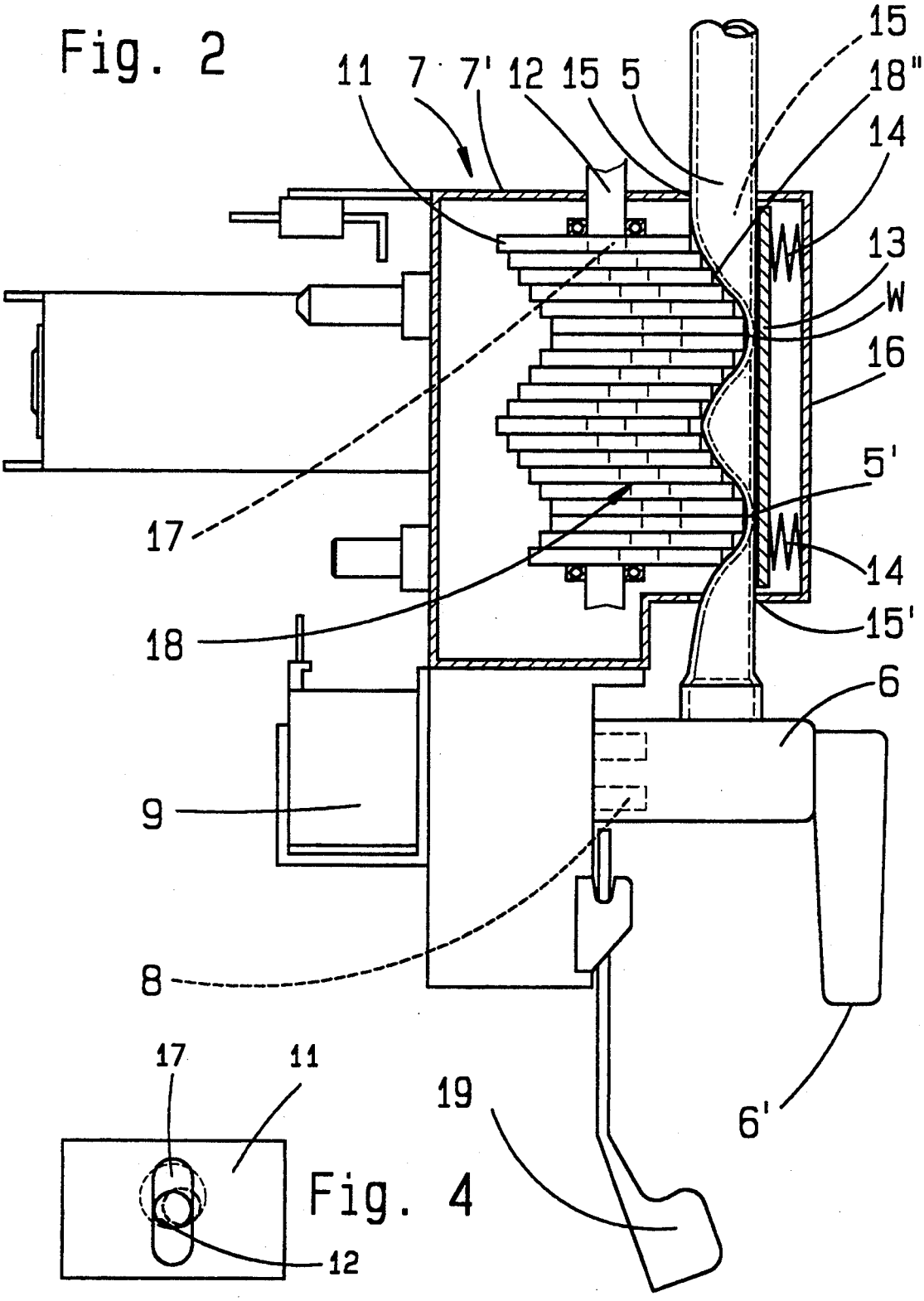
FIG. 2 is a sectional view through a hose pump of a first embodiment.
FIG. 4 is an individual showing of a plate.
Figure 5:
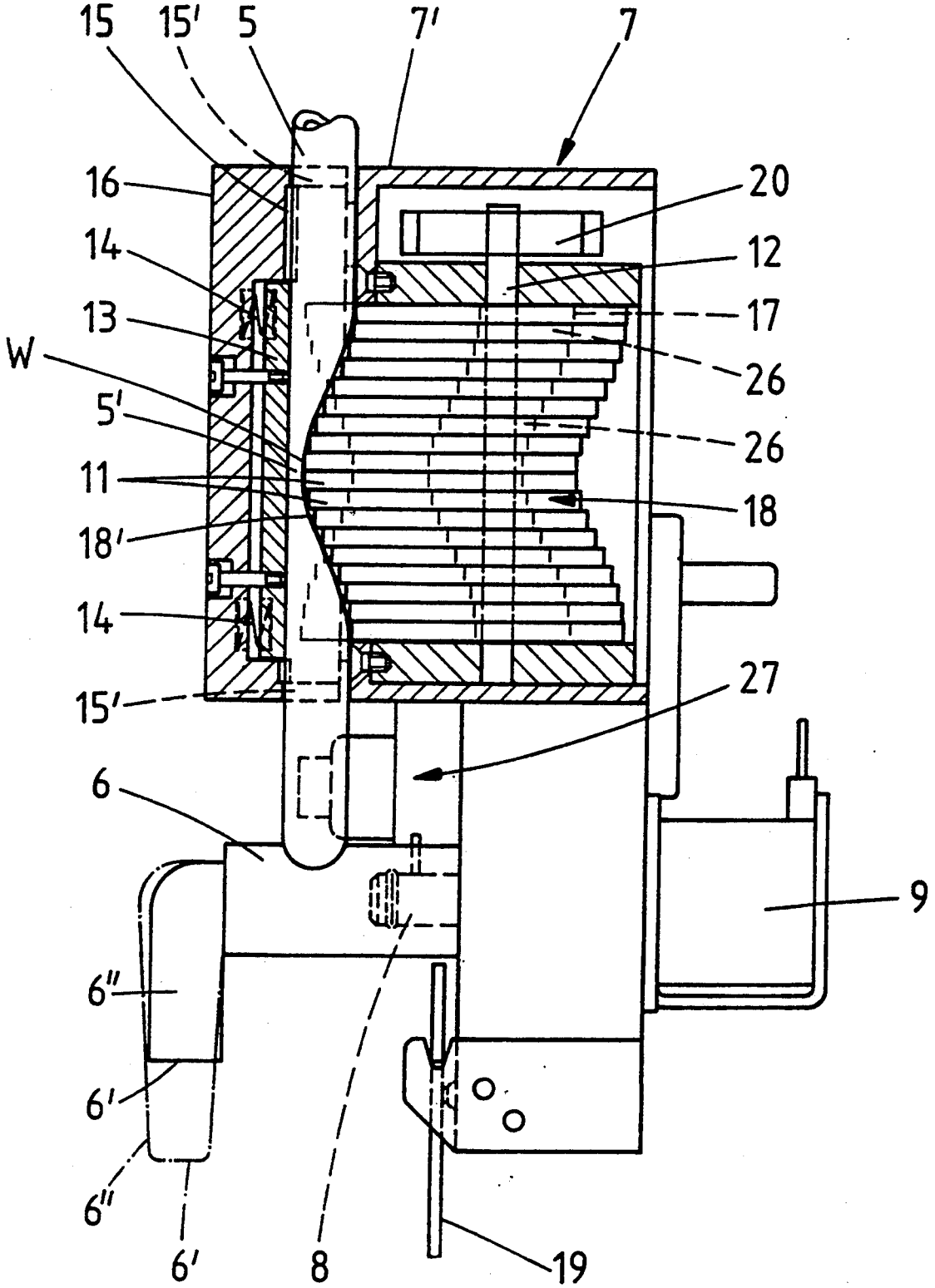
FIG. 5 shows the hose pump, partially broken away in order to show the wavy line of the plate block.

In the case of the hose pump 7 shown in FIGS. 2 and 5, the concentrate is conducted, by means of a squeezing contour W extending in direction of conveyance, through the spigot hose 5 into the spigot valve 6, which is open in the position of rotation shown therein (downward) of the spigot spout 6'' having the spigot opening 6'. The spigot valve 6 is placed on the water-feed device 8, the water-feed device being adapted to be opened and closed by a solenoid valve 9. The water flowing through the water-feed device 9 is maintained at a constant rate of flow by a flow-control device 27 shown in FIG. 6, so that a given period of opening of the solenoid vale 9 corresponds to a given amount of water discharged by the water feed device 8.

Within the hose pump 7, the spigot hose 5 lies within a hose-receiving chamber 15 which is limited on one side by the plates 11 which are arranged in wave shape and form the squeezing contour W, and on the other side by a rear wall 13 which is under spring action. The corresponding compression springs can be noted from FIGS. 2 and 4 and are designated 14. The rear wall 13 is associated with an opening flap 16 which can be opened in forward direction in order to insert the spigot hose 5 into the hose receiving chamber 15. For this purpose, the opening flap 16 is hinged around a vertical axis on the pump housing 7'.

The plates 11 which are movable back and forth transversely and therefore crosswise to the direction of conveyance in the direction of the hose receiving chamber 15, i.e. to the linear direction of extension of the spigot hose 5, have, in their center, a slot 17 (see FIG. 4), extending transverse to the said direction of movement, into which slot a helically developed eccentric shaft 12 engages. The eccentric shaft 12 passes through all plates 11 of the plate block 18 and in this way impresses on the plate-block end 18' extending into the hose-receiving chamber 15 the wave shape developing the squeezing contour W shaped in accordance with the helical shape of the eccentric shaft 12. The squeezing contour W corresponds, in accordance with FIG. 5, to at least a half of the length of a wave of a wavy line which alternately intersects the geometric line of extent. The eccentricity of the eccentric shaft 12, and thus the maximum transverse stroke of a plate 11, corresponds approximately to the diameter of the hose. In this way, a dependable constriction 5' of the spigot hose 5 by the squeeze contour W is assured, particularly as the width of the end surface of the equally wide plates 11 corresponds to a multiple of the outside diameter of the spigot hose 5 of round cross section and also produces the constriction 5' with the body of the hose pressed flat.

Upon the rotation of the eccentric shaft 12 around its axis, the plates 11, which are stacked one above the other, carry out a phase-shifted movement back and forth in such a manner that the constriction of the spigot hose 5—forming the peristalsis—moves in the direction of conveyance.

The ratio of concentrate to water fed can be adjusted by the speed of conveyance of the hose pump 7 corresponding to the speed of rotation of the eccentric shaft 12. Upon actuation of a release lever 19, for instance by a cup which is held below the spigot opening 6', both the water feed and the hose pump 7 are placed in operation.

The spigot hose 5 is securely positioned lying behind the flap 16 in the hose-receiving chamber 15 in the said linear extent on the pump housing 7'. This is achieved by openings 15 on the side of the hose chamber. Such openings 15' are located on the feed side of the spigot hose 5 on the top of the pump housing 7' and also on the bottom side thereof, in front of the place of attachment of the spigot hose 5 to the spigot valve 6. They can be niches adapted to the cross section of the spigot hose 5. Such niches may suitably extend from the inside of the opening flap 16. The rear wall which is under spring load is then aligned with the bottom of the niche in the direction of the hose chamber 15. The rear wall can have a suitable receiving groove for the spigot hose.

Figure 3:
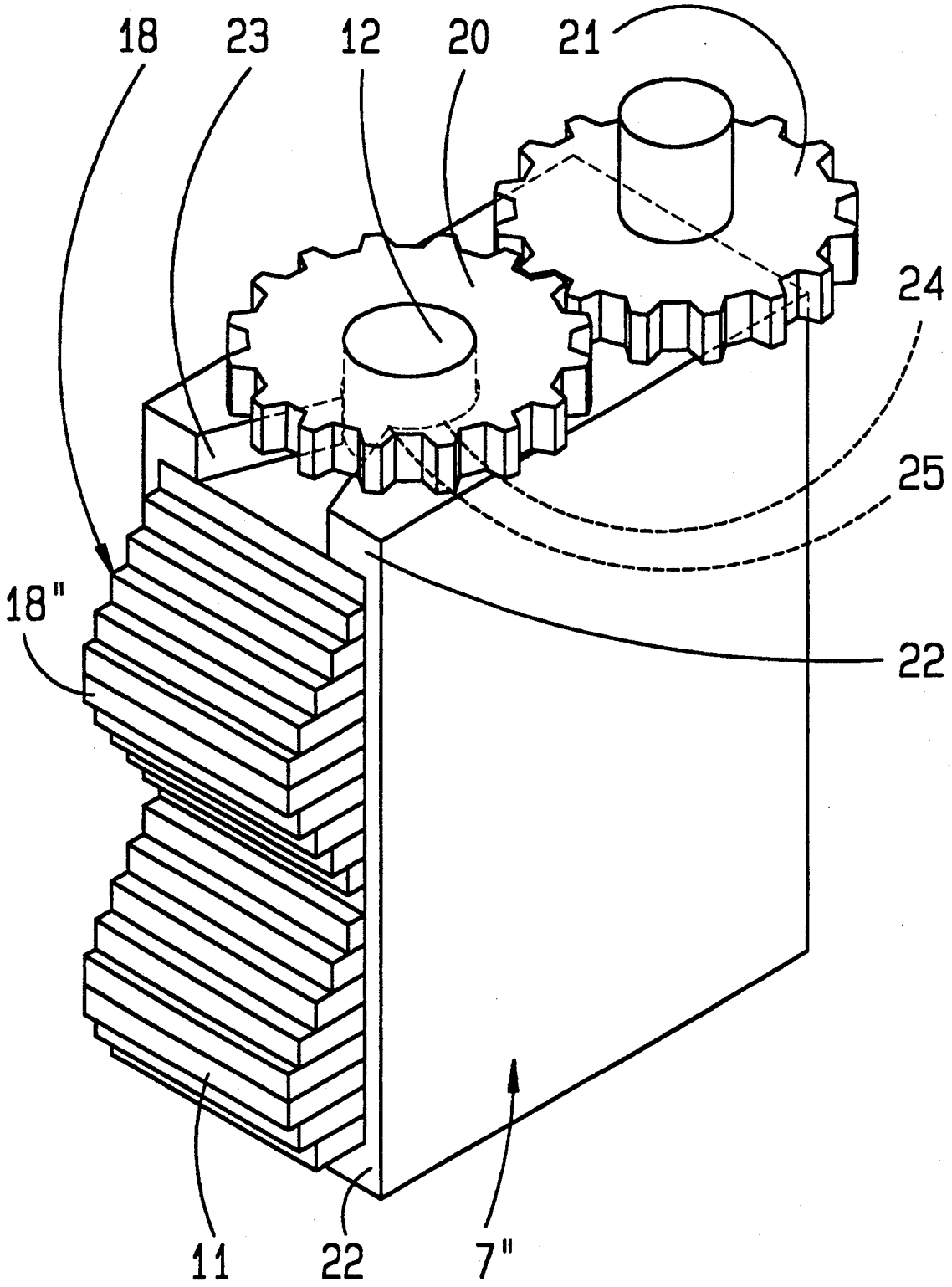
FIG. 3 is a perspective view of a housing having a clippable plate block in accordance with a second embodiment.

FIG. 3 shows a second embodiment of the invention. Within a pump housing 7' there is a plate block 18 consisting of a plurality of plates 11 stacked one above the other, the eccentric shaft 12 in this case also being inserted through the slots in the plates 11o At the end, the eccentric shaft 12 has a gear 20 which is driven by a drive gear 21 operated by an electric motor (not shown). The electric motor preferably forms a preassembly unit together with the hose pump 7. The plate block 18 can be removed together with the eccentric shaft 12 from the pump housing 7' of shaft shape. For this purpose, the housing wall 22 has openings 23 which continue up to an eccentric shaft bearing 24. In this connection, the openings 23 are associated with opposites ends of the pump housing. In the embodiment shown, the openings 23 debouch on the side of the hose receiving chamber in the direction of the end 18' of the plate block. The eccentric shaft 12 is clipped in its bearing 24 by the opening 23. For this purpose, the opening has a narrowing 25 at which the opening is smaller than the diameter of the eccentric shaft at its bearing point. In this way, a simple attaching of the eccentric shaft 12 in the pump housing 7' is assured. By the overcoming of the detent force, the plate block 18 can be pulled out of the housing 7', together with the eccentric shaft 12, and cleaned. Since when the opening flap 16 is closed (not shown in FIG. 3) the end 18' of the plate block is acted on by force—not least of all because of the spring-actuated rear wall 13 and the elasticity of the hose 5—the axial attachment can be developed very weak. The constriction 25 need therefore be only slightly narrower than the bearing diameter of the eccentric shaft 12. Dependable tooth engagement between the gears 20 and 21 is then assured by the action of the force.

The helical eccentric shaft 12 consists in both embodiments of circular disks 26 which are arranged staggered one above the other, their thickness corresponding to the thickness of the plates 11. Due to the uniform angular shift from step to step the eccentric shaft 12 is thus imparted a helical shape. The eccentric shaft 12 has at least one complete revolution so that assurance is had that in every position of rotation a squeezing contour W is formed, this squeezing contour W effecting a sealing constricting 5' of the spigot hose 5.

As is more specifically shown in FIG. 5, the physical axis of the eccentric shaft 12 which at the same time forms the journal pins passes through all the said circular disks 26.

Figure 6:
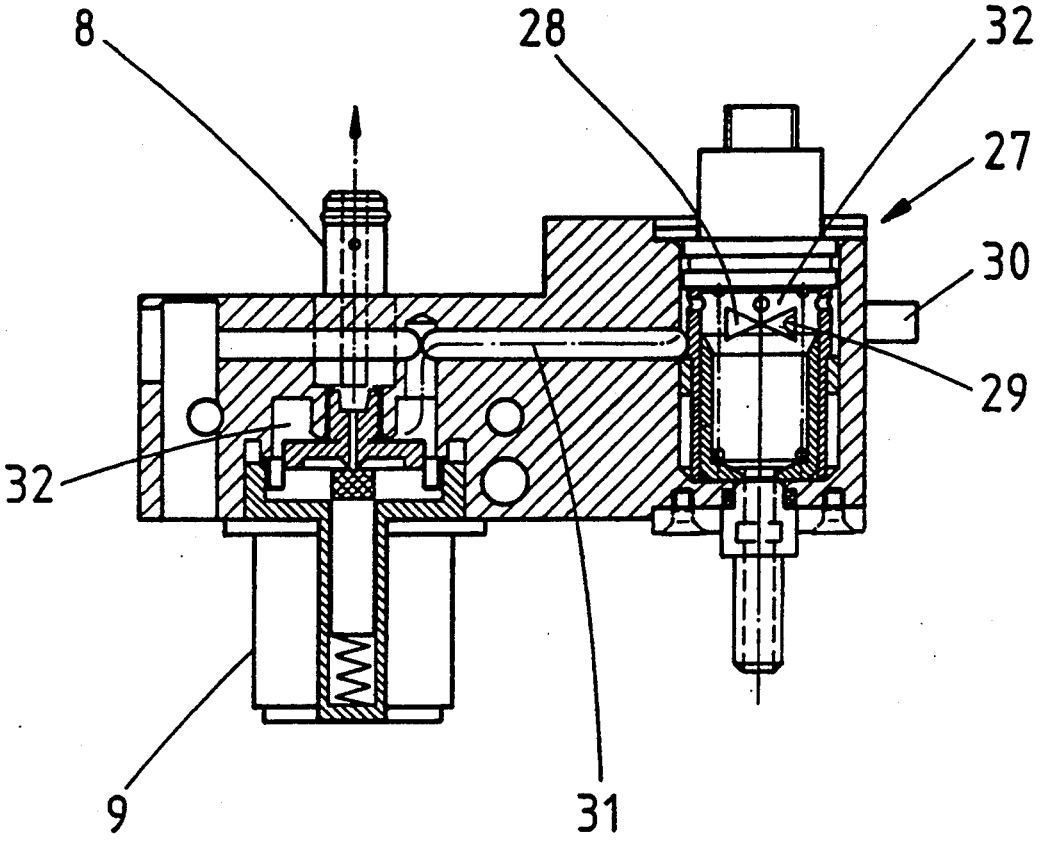
FIG. 6 is a section through the lower portion of the hose pump, showing the flow control device.

FIG. 6 shows the flow-control device 27 associated with the hose pump 7. This device is seated in the bottom portion of the hose pump 7. The flow-control device 27 controls, by valve control, the feed of water for the concentrate. This takes place in the manner that a given period of opening of the solenoid valve 9 of the water-feed device 8 corresponds to a given amount of water admitted. For this purpose, it has a transmitter device. This is a signal impeller 28 inserted in the flow stream. Its signal is used to control the drive voltage of the electric motor of the hose pump. The motor is a dc motor.

The signal impeller 28 bears a small magnet 29 on one of its vanes which turn within the flow stream. A pulse receiver 30 arranged in the housing section of the flow-control device 27 records the approach-produced pulses and converts them into the adjusted speed of operation of the electric motor of the hose pump 7.

Regardless of the water pressure, the same mixing quality of concentrate to water is thus obtained at all times. By means of a connecting channel 31, the impeller chamber 32 is in communication with a chamber 32 of the solenoid valve 9 via which the water-feed device 8 is fed.

I claim:

1. A fruit juice dispenser having a receiving device for receiving a concentrate container which is equipped with a spigot hose, said dispenser having a hose pump with a pump housing enclosing said hose pump, said dispenser including a housing wall which is driven by an electric motor and includes a squeezing means which extends into a hose receiving chamber portion of said pump housing, said squeezing means being displaceable in the direction of conveyance of the juice through the spigot hose;

said dispenser having an electromagnetically controlled water feed device arranged between the hose pump and a spigot opening, said hose pump comprising a plate-block having a squeezing contour which operates as the hose pump and against which the spigot hose is pressed by means of a spring biased rear wall of a flap of the pump housing which can be opened in a forward direction for the insertion of the spigot hose within the hose receiving chamber;

said apparatus further comprising openings in the hose receiving chamber side of the pump housing wall which form bearings for an associated plate block eccentric shaft for the removal of said plate block thereon, including the eccentric shaft, from the pump housing.

2. A fruit juice dispenser according to claim 1, wherein said pump housing has openings on a hose-chamber side of the housing for passage of the spigot hose.

3. A fruit juice dispenser according to claim 1, wherein the eccentric shaft is attached by clipping to the openings on the hose-chamber-receiving side of the pump housing which form the bearings.

4. A fruit juice dispenser according to claim 1, wherein a width of an end surface of each of the plates corresponds to a multiple of a diameter of the spigot hose.

5. A fruit juice dispenser according to claim 1, wherein the squeezing contour corresponds to half the length of a wave.

6. A fruit juice dispenser according to claim 1, further comprising a flow control device for feeding water, wherein said water feed device includes a solenoid valve, said flow-control device being operative with the solenoid valve such that a given period of opening of the solenoid valve of the water-feed device corresponds to the amount of water fed.

7. A fruit juice dispenser according to claim 6, wherein the flow-control device comprises a signal impeller which is rotated by flowing water and provides signals which serve to control a drive voltage of the electric motor of the hose pump.

* * * * *